US011795649B2

(12) United States Patent
England et al.

(10) Patent No.: US 11,795,649 B2
(45) Date of Patent: Oct. 24, 2023

(54) APPARATUS AND METHOD FOR SUBSEA WALL INSERTION

(71) Applicant: SOLETANCHE FREYSSINET, Rueil Malmaison (FR)

(72) Inventors: Steven England, Rueil Malmaison (FR); Stefano Gabaldo, Rueil Malmaison (FR)

( * ) Notice: Subject to any disclaimer, the term of this patent is extended or adjusted under 35 U.S.C. 154(b) by 360 days.

(21) Appl. No.: 17/053,465

(22) PCT Filed: May 7, 2019

(86) PCT No.: PCT/EP2019/061744
§ 371 (c)(1),
(2) Date: Nov. 6, 2020

(87) PCT Pub. No.: WO2019/215196
PCT Pub. Date: Nov. 14, 2019

(65) Prior Publication Data

US 2021/0222387 A1 Jul. 22, 2021

(30) Foreign Application Priority Data

May 9, 2018 (CA) ..... 3004561

(51) Int. Cl.

| | |
|---|---|
| ***E02D 13/04*** | (2006.01) |
| ***E02D 7/16*** | (2006.01) |
| ***E02D 13/10*** | (2006.01) |
| ***E02D 5/06*** | (2006.01) |
| ***E02D 5/08*** | (2006.01) |

(52) U.S. Cl.
CPC ..... *E02D 5/06* (2013.01); *E02D 5/08* (2013.01); *E02D 7/16* (2013.01); *E02D 13/04* (2013.01); *E02D 2300/0029* (2013.01)

(58) Field of Classification Search
CPC .. E02D 5/06; E02D 5/08; E02D 13/04; E02D 7/16; E02D 5/16; E02D 5/54; E02D 7/00; E02D 13/00
See application file for complete search history.

(56) References Cited

U.S. PATENT DOCUMENTS 5,800,096 A * 9/1998 Barrow ..... E02D 7/26 405/249
7,585,136 B2 9/2009 Biserna et al.
(Continued)

FOREIGN PATENT DOCUMENTS

JP H11256576 A 9/1999
JP 2017101413 A * 6/2017
(Continued)

OTHER PUBLICATIONS

English language abstract of NL 1033368.
English language abstract of JP H11256576.
English language abstract of WO 2017045625.

*Primary Examiner* — Benjamin F Fiorello
*Assistant Examiner* — Stacy N Lawson
(74) *Attorney, Agent, or Firm* — Brian Gordaychik

(57) ABSTRACT

A lead for installing a pile into a seabed floor comprising: an elongated body extending longitudinally along a first axis in a first direction from a top end to a bottom end and configured to receive a pile oriented in the first direction; and a lead indexing foot attached to the bottom end of the elongated body and laterally offset with regard to the first axis.

2 Claims, 5 Drawing Sheets

(56) References Cited

U.S. PATENT DOCUMENTS

| | | | | |
|---|---|---|---|---|
| 9,677,340 | B1 | 6/2017 | Gochis | |
| 2004/0055789 | A1* | 3/2004 | Comacchio | E21B 19/084 175/162 |
| 2008/0017418 | A1* | 1/2008 | Youn | E02D 5/06 175/121 |
| 2011/0170956 | A1 | 7/2011 | Vandenbulcke | |
| 2015/0218765 | A1 | 8/2015 | Bermingham et al. | |

FOREIGN PATENT DOCUMENTS

| | | | | |
|---|---|---|---|---|
| JP | 2017222982 | A | * | 12/2017 |
| JP | 2019157499 | A | * | 9/2019 |
| NL | 1033368 | C2 | | 8/2008 |
| WO | 20100124386 | A1 | | 11/2010 |
| WO | 2017045625 | A1 | | 3/2017 |

* cited by examiner

APPARATUS AND METHOD FOR SUBSEA WALL INSERTION

FIELD OF THE DISCLOSURE

This disclosure relates to an apparatus used for construction of subsea foundation structures having an indexing foot and mounted to a platform arranged to move along an existing dock structure. This type of structure may be in the form of interlocking pipe piles, sheet piles, or combi-wall, or any other foundation type that requires high element-to-element precision. These elements may be driven using an impact hammer, a vibratory hammer, or drilled into place using a variety of tools.

BACKGROUND OF THE DISCLOSURE

A common method for constructing a seabed wall structure is to use a temporary template structure or falsework to position and align the piles prior to and during installation. However, existing systems for the installation of subsea walls typically require the use of extensive falsework systems or use falsework that extends below the waterline to provide support for the piles during installation. Often divers are used in conjunction with falsework to confirm alignment and/or successful pile to pile interlock.

An alternate method of installation is to extend the length of the pile to the waterline, which simplifies construction, and cut off the ends of the piles once the installation is completed. A related construction method can be found in US 2015/0218765 which discloses a dock building apparatus and method of construction. Another related construction method can be found in U.S. Pat. No. 7,585,136 which discloses a method and equipment for making an impermeable diaphragm of secant piles.

A number of limitations stem from the common methods for constructing a seabed wall structure. First, the construction rate is typically limited by the movement and setup time of the falsework; second, the cost of the falsework can be significant, depending on the pile geometry, water depth, and accuracy required; third, in many cases, the installation must be carried out during the day time, or have a limited production rate at night; and fourth, the method that cuts off the ends of piles requires additional operations and material, which affects productivity and cost.

Therefore, it is the object of the present disclosure to solve the above described problems and provide an improved construction apparatus and method for construction of subsea structures that is able to locate piles accurately underwater with very high precision from a land based system without extensive falsework.

SUMMARY OF THE DISCLOSURE

According to an aspect of the present disclosure, a lead for installing a pile into a seabed floor is provided. The lead may comprise an elongated body extending longitudinally along a first axis in a first direction from a top end to a bottom end and configured to receive a pile oriented in the first direction; and a lead indexing foot attached to the bottom end of the elongated body and laterally offset with regard to the first axis.

The lead having at least one lead indexing foot allows the lead to be inserted into an existing foundation structure, e.g., previously installed piles, which fine tunes the alignment of the lead at seabed elevation. This also allows for seabed installation during times of low visibility, for example, turbulent water or night time.

In aspects, an apparatus for installing a subsea wall into a seabed floor is provided. The apparatus may comprise a lead according to the aforementioned embodiment installed in the apparatus so as to be movable in at least a second direction that is perpendicular to the first direction; and a pile insertion device configured to drive a pile in the first direction into the seabed floor.

Providing a movable pile insertion apparatus having a pile insertion device allows for an efficient installation of multiple piles in different locations.

In aspects, the apparatus for installing a subsea wall into a seabed floor may further include a template configured to connect to the lead, wherein the template is adapted to move in the second direction.

Having a detachable template allows for the template to be moved concurrently with a pile being loaded into the lead.

In aspects, the apparatus for installing a subsea wall into a seabed floor may further comprise at least one rail that is configured to be mounted on the ground, wherein the template is slidably connected to the at least one rail.

Providing a template that is slidably connected to a rail allows for an efficient installation of multiple piles in different locations.

In aspects, the apparatus for installing a subsea wall into a seabed floor, where the at least one rail may extend in the second direction.

Providing an extended rail allows the template and attached lead to move accurately along the second direction, which improves the efficiency and accuracy of the installation of piles to make a seabed wall.

In aspects, the apparatus for installing a subsea wall into a seabed floor, where the lead is hinged around at least one pivot axis with respect to the template.

Providing at least one pivot axis permits control of the pile alignment and position. For example, in a case where there is a construction deviation in the piles, the lead may be adjusted to steer the pile position to maintain the construction within a specified tolerance. Additionally, the lead may be configured to pivot about a second or third pivot axis, which would permit greater control over the pile alignment and position.

In aspects, the apparatus for installing a seabed wall into a seabed floor, where the lead is lockable in rotation with respect to the template.

Allowing the lead to be fixed in a rotated position relative to the template permit greater control over the pile alignment and position as the lead to account for construction deviation in the piles.

In aspects, the apparatus for installing a subsea wall into a seabed floor, wherein the lead further includes a lead gate and an indicator configured to indicate whether the lead gate is open or closed.

The lead gate is adapted to hold the pile within the lead until the lead is properly aligned with an existing foundation structure, i.e., previously installed pile. The advantage of the lead gate is that the pile is securely held in place until it is determined that the lead is properly aligned. This prevents unwanted movement of the pile during the initial phase of installation. Further, the lead gate having an indicator, for example hydraulic flags, is a feedback means that provides visual feedback on the gate position (open/close) even when water turbidity prevents visual confirmation or during a night time installation.

In aspects, a method of driving a pile into a seabed floor adjacent to an existing foundation structure is provided. The method may comprise lowering a lead longitudinally oriented in a first direction toward the subsea floor; engaging a lead indexing foot of the lead with the existing foundation structure; and advancing the pile, along the lead, in the first direction into the subsea floor.

In this configuration, the lead indexing foot allows the lead to align with the existing foundation structure. Because the lead is indexed with the existing foundation structure, it is possible to install the pile during times with low viability, for example, turbulent water or night.

In aspects, the method may further comprise inserting an interlock of the pile into an interlock of the existing foundation structure.

In this configuration, the interlock ensures that the pile is properly aligned while the pile is being driven into the seabed floor.

In aspects, the method may further comprise determining whether the interlock of the pile has engaged the interlock of the adjacent existing foundation structure.

Determining whether the respective interlocks are properly engaged prior to driving the pile into the seabed floor prevents damage to the pile, damage to the existing foundation structure, and improper placement of the pile.

In aspects, the method may further comprise attaching the lead to a template that is adapted to move in a second direction that is perpendicular to the first direction.

Having a detachable template allows for the template to be moved concurrently with a pile being loaded into the lead.

In aspects, the method may further comprise adjusting the location of the lead by moving the template on at least one rail.

The benefit of providing a template that is slidably connected to a rail allows for an efficient installation of multiple piles in different locations.

In aspects, the method may further comprise loading the pile onto the lead prior to the step of lowering the lead in the first direction.

This method may be preferable, for example, while performing an installation in turbulent water so that the lead does not remain submerged for longer than required.

In aspects, the method may further comprise loading the pile onto the lead after the step of lowering the lead.

This method may be preferable, for example, while performing an installation in placid water. This method reduces the instillation time because the entire lead can be adjusted contemporaneously with the template rather than be disconnected therefrom.

It is intended that combinations of the above-described elements and those within the specification may be made, except where otherwise contradictory.

The accompanying drawings, which are incorporated in and constitute a part of this specification, illustrate embodiments of the disclosure and together with the description, and serve to explain the principles thereof.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

Figure 1:
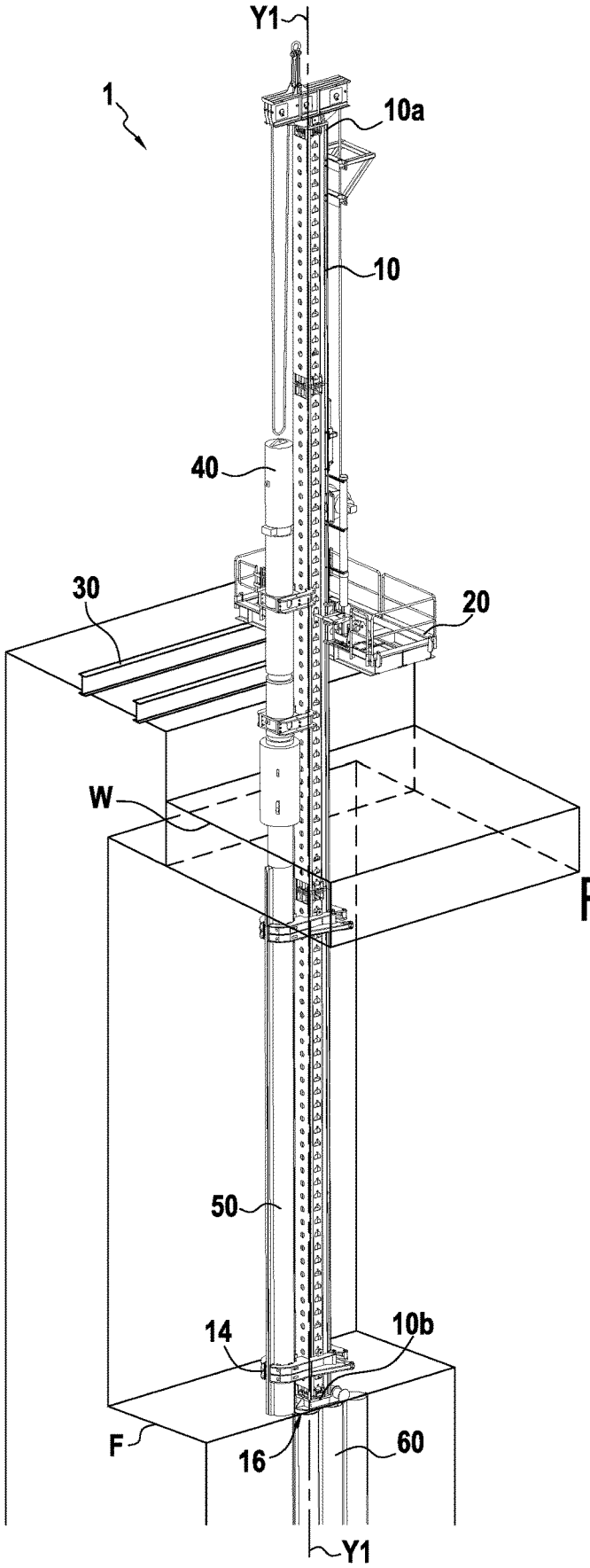
FIG. 1 is a perspective overview of an apparatus for installing subsea foundation elements.

FIG. 1 shows an apparatus for installing a seabed wall 1. The apparatus may include a lead 10, a template 20, rails 30, and a pile insertion device 40.

The lead 10 comprises a long structural column that extends along an axis Y1 from a top end 10*a* to a bottom end 10*b*; the top end 10*a* is higher in elevation than the bottom end 10*b*.

The lead 10 is a self-supporting system that uses integrated winches or crane winches to control the lead lift and elevation, the tool (e.g., pile driving hammer) lift and elevation, and the pile lift and elevation. The lead 10 is also equipped with an integrated slide 12 (shown in FIG. 4) which has a built-in interlock with the template 20 and a range of motion (vertical movement) suitable for a specific project. The hydraulic power that actuates the lead 10 integrated systems (winches, guiding gates and driving/drilling tools) is provided by the supporting crane hydraulics or additional valve control system with a separate power pack unit or a combination of both (not shown).

Figure 2:
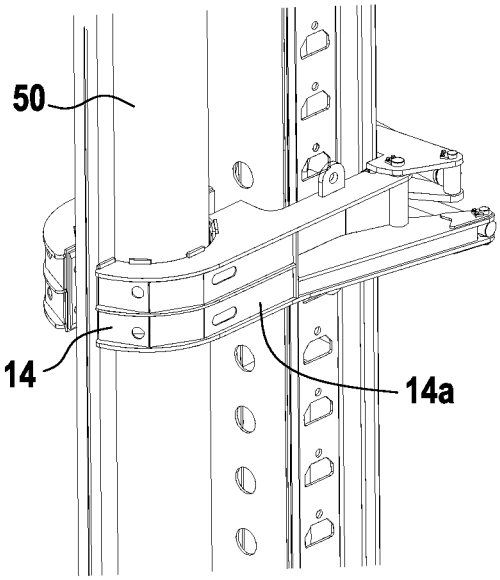
FIG. 2 is a perspective view of an apparatus shown in FIG. 1, showing an embodiment of a pile gate.

As shown in FIG. 2, the lead 10 may have one or several gates 14 that are configured to position and align a foundation element, for example, a pile 50, relative to the lead 10. The gate 14 may include at least one gate arm 14*a*, that may be configured to swing between open and closed positions. The opening and closing of the gate arm 14*a* may be controlled by any suitable means, for example, hydraulics.

The lead 10 may further comprise a lead indexing foot 16 that extends along an axis Y2 that is laterally offset from the lead axis Y1. The lead indexing foot 16 is attached to the bottom end 10*b* of the lead. The lead indexing foot 16 may be joined to the bottom end 10*b* of the lead by, for example, welding or the lead indexing foot 16 may be fully integrated with the lead 10 as a unitary piece.

Figure 3:
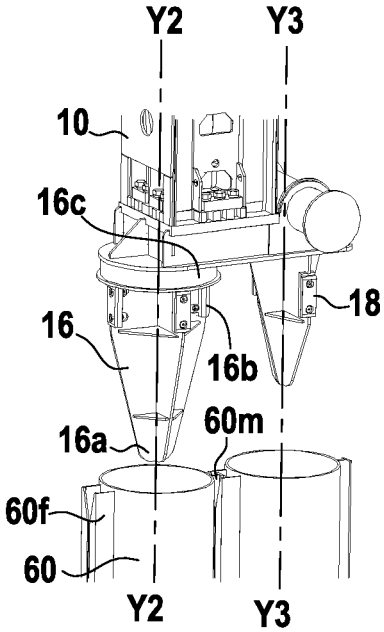
FIG. 3 is a perspective view of an apparatus shown in FIG. 1, showing an embodiment of an indexing foot.

As shown in FIG. 3, the lead indexing foot 16 may form a tip portion 16*a* that is configured to align with an opening of an existing foundation structure 60, for example, a previously installed pile, group of piles, sheets, submerged supports laying on the seabed, etc. The lead indexing foot 16 further comprises a fitted portion 16*b* that is configured to at least partially contact an interior surface of the opening of the existing foundation structure 60. The lead indexing foot 16 further comprises a base portion 16*c* that is configured to interface with a top end 60*a* of the existing foundation structure 60.

The radial distance $r_a$ from the axis Y2 of the tip portion 16*a* may be smaller than a radial distance $r_b$ from the Y2 axis than the fitted portion 16*b*. A surface that extends between the tip portion 16*a* and the fitted portion 16*b* of the lead indexing foot 16 may be tapered.

The lead 10 may further comprise a second lead indexing foot 18 that is configured to align and interface with another portion of the existing foundation structure 60, for example, an adjoining previously installed pile. The second lead indexing foot 18 may extend along a third axis Y3 that is laterally offset from both the lead axis Y1 and the first indexing foot axis Y2. This second lead foot can be used to provide additional alignment of the lead and pile.

Figure 4:
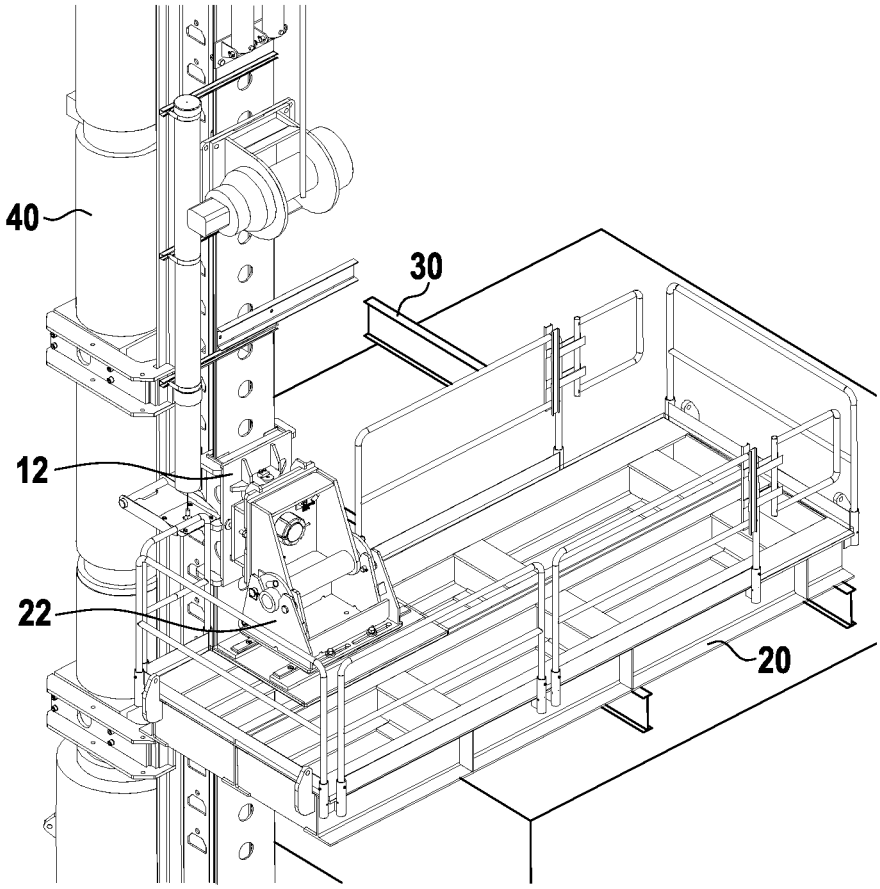
FIG. 4 is another perspective view of an apparatus shown in FIG. 1, showing an embodiment of the moveable template and leader connection.

As seen in FIG. 4, the ground level template 20 consists of a structural frame that is installed on rails 30, which aid in the alignment and movement of the template 20. The template 20 and rails 30 may be made of any suitable material, for example, steel, iron, aluminium, etc.

The position of the template 20 can be fixed or can be moved to a predetermined location based on the required foundation spacing. The template 20 is configured to be removeably connected to the lead 10.

The template 20 may have a pivotable connection 22 with the lead 10. For example, the pivotable connection 22 of the template 20 may be configured to pivot the lead 10 about a first pivot axis so that an operator can account for any construction deviation in the piles and the lead may be adjusted to steer the pile position to maintain the construction within a specified tolerance. The pivotable connection 22 may be further configured to pivot the lead about a second or a third pivot axis. The pivotable connection 22 may be lockable such that the lead 10 can be locked into place after pivoting it about a first, second, and/or third pivot axis.

The pile insertion device 40 may be attached to the lead 10 by any suitable means, for example, fasteners. The pile insertion device 40 may be attached proximate to the top end 10*a* of the lead 10. The pile insertion device 40 may be any appropriate means to insert a pile into a seabed floor F, for example, a pile driving vibrating or impact hammer.

In operation, the template 20 is installed on rails 30 or rollers that are leveled and aligned with a subsea pile grid along the wall to be constructed. After assembly of the lead 10 and appropriate placement of the template 20, the lead 10 is held vertically with the lead indexing foot 16 touching the ground or connected to a supplied stand that limits movement during pile 50 lifting and loading.

Figure 5:
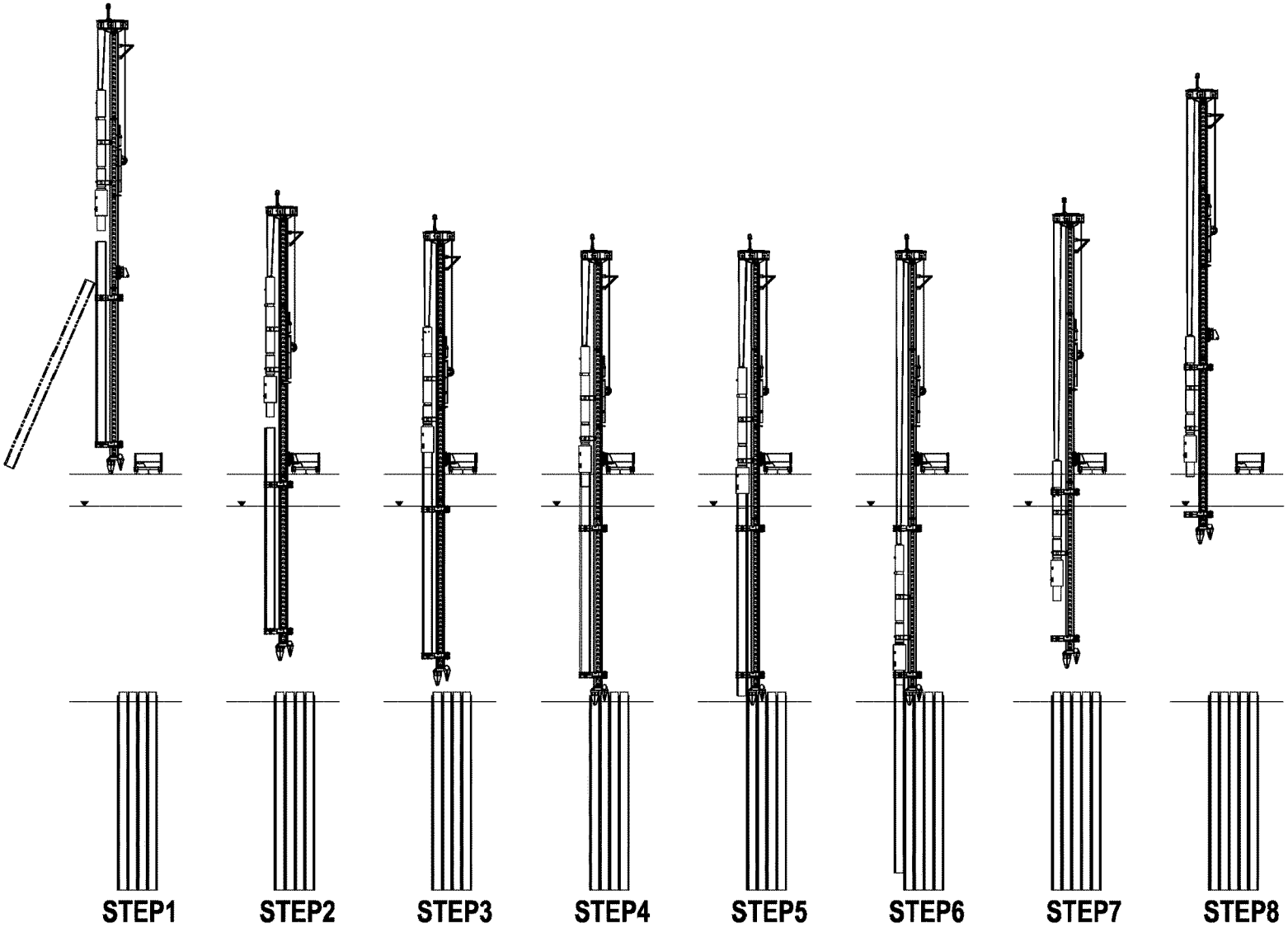
FIG. 5 is a methodology diagram showing how a subsea wall is constructed.

As shown in FIG. 5, the hydraulic gate 14 is opened and then the pile 50 is connected to the pile line and lifted vertically using a crane or integrated lifting winches. The hydraulic gate 14 is subsequently closed such that the pile 50 interlocks 50*f*, 50*m* are now aligned with the pile line. The interlocks 50*f*, 50*m* will be discussed in more detail with reference to FIG. 6.

The lead 10 having the pile 50 therein is lifted, moved, and then lowered to be connected to the template 20. The lead assembly may be lifted using a crane. The lead integrated slide engages the template 20 by locking thereto. The provided locks, which have 3 axis lockable rotation, are engaged to maintain proper alignment in the horizontal and vertical directions, as well as prevent unwanted movement.

The lead 10 is then lowered toward the seabed floor F. The lead 10 is maintained in a vertical position, which can be monitored with, for example, inclinometers, plumb system, or hand held level tools. As the lead 10 is lowered, the tip portion 16*a* of the lead 16 will initially be inserted into the opening of an existing foundation structure 60, e.g., previously installed pile. The tapered surface between the tip portion 16*a* and fitted portion 16*b* pilots the lead indexing foot 16 until the existing foundation structure contacts the base portion 16*c* of the lead indexing foot 16. Thus, the lead indexing foot 16 is inserted into and is supported by the existing foundation structure 60. In this configuration, the lead 10 is substantially connected to the lead indexing foot 16.

As can be seen in FIG. 3, it is envisioned that the lead 10 may have a second lead indexing foot 18 that is configured to engage another portion of the existing foundation structure 60 in a similar manner as the previously discussed, first lead indexing foot 16. The second lead indexing foot 18 may extend along an axis Y3 that is laterally offset from axes Y1 and Y2. The second lead indexing foot 18 may have a similar shape as the first lead indexing foot 16 and be disposed on the second end 10*b* of the lead 10.

Figure 6:
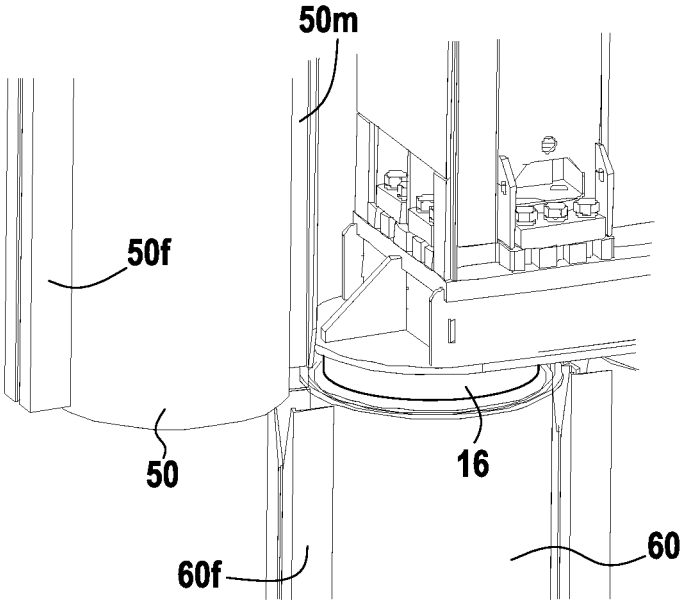
FIG. 6 is a perspective view of a foundation element being installed.

Turning to FIGS. 5 and 6, after at least one lead indexing foot 16 is fully inserted into the existing foundation structure 60, the pile 50 that is loaded in the lead 10 is in proper alignment and can be lowered.

The pile 50 has interlocks 50*m*, 50*f* that is adapted to engage interlocks 60*m*, 60*f* of the existing foundation structure 60. For example, at least a portion of pile 50 may have a male type interlock 50*m* that extends along a length of the pile 50, parallel to axis Y1. The existing foundation structure 60, which may be an existing pile, may have a female type interlock 60*f* that extends along a length of the existing foundation structure 60, parallel to axis Y2. Therefore, when the pile 50 is being lowered toward the seabed floor F, the respective interlocks 50*m*, 60*f* engage each other. Any suitable interlocking means may be implemented, for example a T-shaped protrusion and a corresponding channel. Cameras and/or sensors may be used to ensure that the respective interlocks 50*m*, 60*f* are properly engaged.

After it is determined that the respective interlocks 50*m*, 60*f* are properly engaged, the gates 14 are opened allowing the pile 50 to be lowered to the seabed floor F. Once the pile contacts the seabed floor F, the pile insertion device 40 drives the pile 50 therein. The pile insertion device 40 may be an impact hammer, a vibratory hammer, or a means to drill the pile 50 into the seabed floor F. A feedback means may be used with the gates 14, for example hydraulic flags configured to provide visual feedback on the gate position (open/close) even when water turbidity prevents visual confirmation or during a night time installation.

Once the pile 50 has been installed into the seabed floor F, the lead 10 is elevated vertically, away from the seabed floor F. The lead 10 is moved back into its initial position and thereafter disconnected from the template 20. At this point, a new pile can be loaded into the lead 10. This may be done concurrently with moving the template 20 to the next position. The template 20 may be advanced using a wire rope, winches, or hydraulically actuated cylinders.

The benefits of performing this method of operation using the lead 10 having at least one lead indexing foot 16 is that lowering the lead indexing foot 16 into the existing foundation structure 60, e.g., previously installed piles, fine tunes the alignment of the lead 10 at seabed elevation and allows the lead 10 to index using the existing foundation structure 60. Further, because the lead 10 is indexed with both the existing foundation structure 60 and the template 20, it is possible to determine the position and alignment of the existing foundation structure 60 by surveying or instrumentation on the lead 10. This enables installation of a seabed wall during times with low viability, for example, turbulent water or night.

An alternative method of installing a pile 50 into the seabed floor F is similar to the previous method, except that the lead 10 is connected to the template 20 without having a pile 50 loaded therein. The lead 10 is then lowered toward the seabed floor F. Similar to the previous exemplary method, the lead indexing foot 16 is inserted into and is supported by the existing foundation structure 60. Also similar to the previous method, it is envisioned that the lead 10 may have a second lead indexing foot 18 that is configured to engage another portion of the existing foundation structure 60.

After at least one lead indexing foot 16 is fully inserted into the existing foundation structure 60, the pile 50 is loaded into or onto the lead 10 and secured with a movable gate 14. The pile 50 is then lowered toward the seabed floor F.

Similar to the previous method, after the respective interlocks 50*m*, 60*f* of the pile 50 and existing foundation structure 60 are properly engaged, the gates 14 are opened allowing the pile 50 to be lowered to the seabed floor F and the pile insertion device 40 drives the pile 50 therein.

After the pile 50 has been installed into the seabed floor F, the lead 10 is elevated vertically, away from the seabed floor F and into its initial position. Thereafter, the lead 10 can be moved concurrently with the template 20 to the next position. The lead 10 and template 20 assembly may be advanced using a wire rope, winches, or hydraulically actuated cylinders.

The benefits of performing this method of operation using the lead 10 having at least one lead indexing foot 16 is that lowering the lead indexing foot 16 into the existing foundation structure 60 remains the same as the previous method in that the lead indexing foot 16 fine tunes the alignment of the lead 10 at seabed elevation and allows the lead 10 to index using the existing foundation structure 60. However, if the installation is occurring in placid or calm water, refraining from disconnecting the lead 10 from the template 20 after every pile 50 is driven, and adjusting the lead 10 with the template 20, expedites the installation process.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A method of driving a pile into a seabed floor adjacent to an existing foundation structure, the method comprising:

loading the pile onto a lead;

lowering the lead, carrying the pile and longitudinally oriented in a first direction, toward the seabed floor;

engaging a lead indexing foot of the lead, laterally offset at a bottom end of the lead, with the existing foundation structure;

inserting an interlock of the pile, separate from the lead indexing foot of the lead, into an interlock of the existing foundation structure; and advancing the pile, along the lead, in the first direction into the seabed floor.

2. The method of claim 1, further comprising determining whether the interlock of the pile has engaged the interlock of the existing foundation structure.

* * * * *